US011612217B2

(12) United States Patent
Dallas

(10) Patent No.: US 11,612,217 B2
(45) Date of Patent: Mar. 28, 2023

(54) FOOTWEAR AND METHOD

(71) Applicant: RED WING SHOE COMPANY, INC., Red Wing, MN (US)

(72) Inventor: Jason Dallas, Ellsworth, WI (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 0 days.

(21) Appl. No.: 17/369,487

(22) Filed: Jul. 7, 2021

(65) Prior Publication Data

US 2022/0007788 A1 Jan. 13, 2022

Related U.S. Application Data

(60) Provisional application No. 63/048,732, filed on Jul. 7, 2020.

(51) Int. Cl.

| | |
|---|---|
| ***A43B 3/24*** | (2006.01) |
| ***A43B 13/18*** | (2006.01) |
| ***A43B 21/42*** | (2006.01) |
| ***A43B 13/37*** | (2006.01) |
| ***A43B 23/02*** | (2006.01) |

(52) U.S. Cl.

CPC ..... *A43B 21/42* (2013.01); *A43B 3/242* (2013.01); *A43B 3/248* (2013.01); *A43B 13/181* (2013.01); *A43B 13/37* (2013.01); *A43B 23/027* (2013.01); *A43B 23/0295* (2013.01)

(58) Field of Classification Search

CPC ..... A43B 3/242; A43B 3/248; A43B 13/181; A43B 13/37; A43B 23/027; A43B 23/0295; A43B 3/10; A43B 3/101; A43B 3/102; A43B 3/108; A43B 9/02; A43B 9/08

See application file for complete search history.

(56) References Cited

U.S. PATENT DOCUMENTS

| | | | | |
|---|---|---|---|---|
| 1,066,596 | A * | 7/1913 | Fulton | A43B 3/101 36/9 R |
| 4,783,909 | A * | 11/1988 | Van Doren | A43B 3/242 36/68 |
| 5,127,170 | A * | 7/1992 | Messina | A43B 23/08 36/105 |
| 6,367,171 | B1 * | 4/2002 | Burt | A43B 3/24 36/105 |
| D716,035 | S | 10/2014 | Lucas | |
| D725,883 | S | 4/2015 | Lucas | |
| 2001/0010128 | A1 * | 8/2001 | Bray, Jr. | A43B 9/08 36/21 |
| 2011/0271556 | A1 * | 11/2011 | Dillenbeck | A43B 7/144 36/43 |
| 2020/0345184 | A1 * | 11/2020 | Carter | A43B 3/108 |

OTHER PUBLICATIONS https://olukai.com/, OluKai, 1 page (Jun. 24, 2020).

* cited by examiner

*Primary Examiner* — Ted Kavanaugh
(74) *Attorney, Agent, or Firm* — Merchant & Gould P.C.

(57) ABSTRACT

Comfortable, protective, durable, and lightweight footwear with minimal component parts. Both the footwear and the method of constructing the same is streamlined.

14 Claims, 10 Drawing Sheets

SOLE UNIT CUT-AWAY VIEW

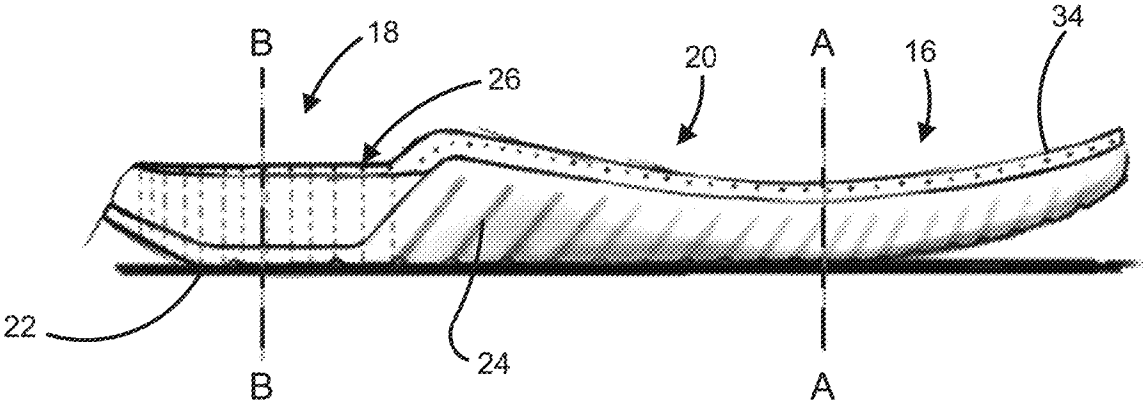
FIG. 11
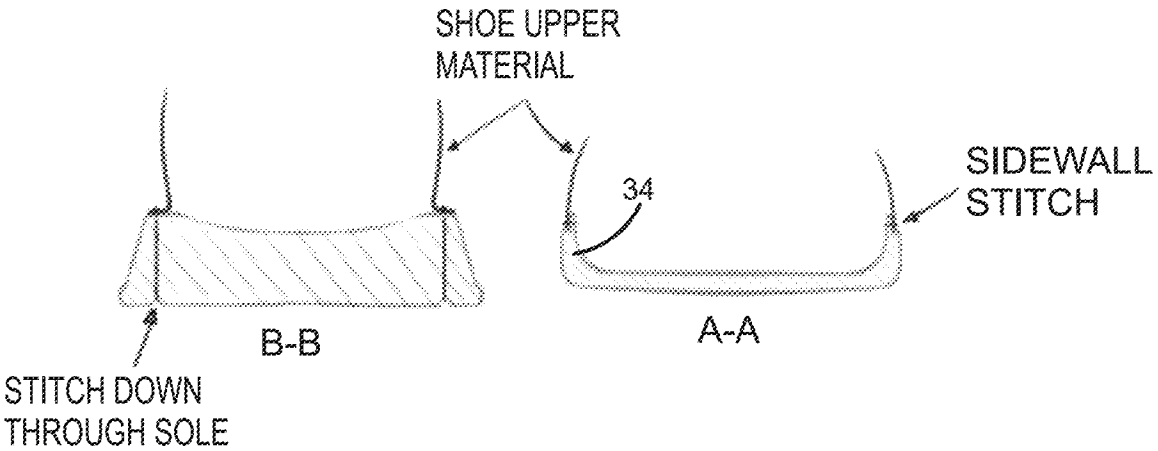
FIG. 12
FIG. 13

FOOTWEAR AND METHOD

CROSS-REFERENCE TO RELATED APPLICATIONS

This application claims priority to U.S. Provisional Application Ser. No. 63/048,732, filed on Jul. 7, 2020, the entire disclosure of which is hereby expressly incorporated herein by reference.

TECHNICAL FIELD

A footwear is provided having a streamlined sole and upper construction.

BACKGROUND

Functional footwear can include a relatively large number of parts and the construction of the such footwear can involve many steps. Footwear soles typically include an outer that provides a tread surface, a midsole that provides cushioning, and a footbed that provides contours for support and comfort. The footwear upper typically includes a heel counter that holds the heel in place and a vamp that covers the forefoot. The vamp typically includes a center tongue that includes gussets on each side and laces that extend over the tongue. The tongue and laces system enables the upper to expand to allow the foot to enter and exit and to contract to secure the foot in the shoe during use.

SUMMARY

The present disclosure provides fully functional footwear with minimal component parts. The footwear provided is comfortable, protective, durable, and lightweight. The footwear design allows it to be constructed in relatively few steps.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 11 is a schematic side elevation view of the sole of the footwear of FIG. 1;

FIG. 12 is a schematic cross-sectional view along B-B of FIG. 9;

FIG. 13 is a schematic cross-sectional view along A-A of FIG. 9;

DETAILED DESCRIPTION

The present disclosure is herein described in greater detail with reference to the figures. The present disclosure provides a footwear 10. The footwear 10 comprises a sole 12 and an upper 14.

Figure 1:
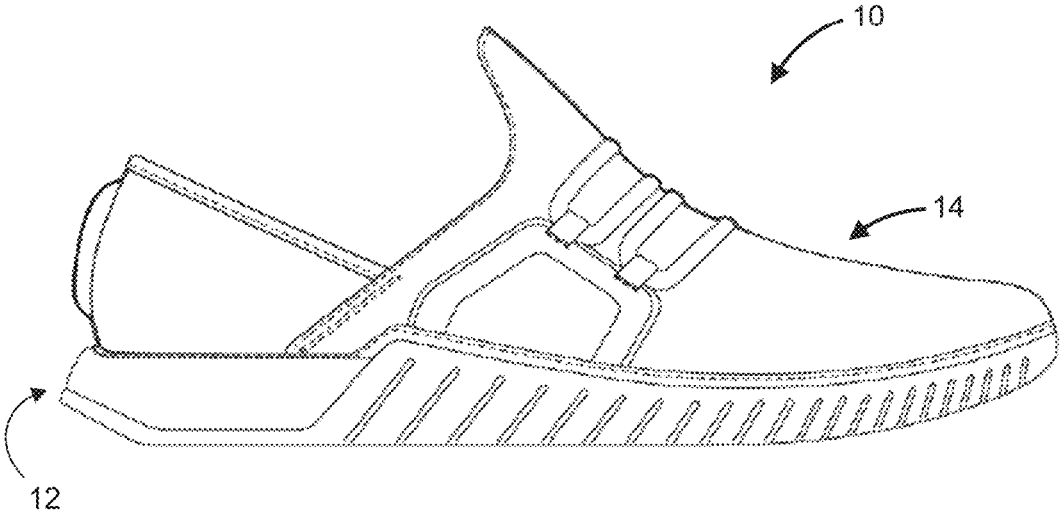
FIG. 1 is a side elevation view of an embodiment of the footwear of the present disclosure in a first state.
Figure 2:
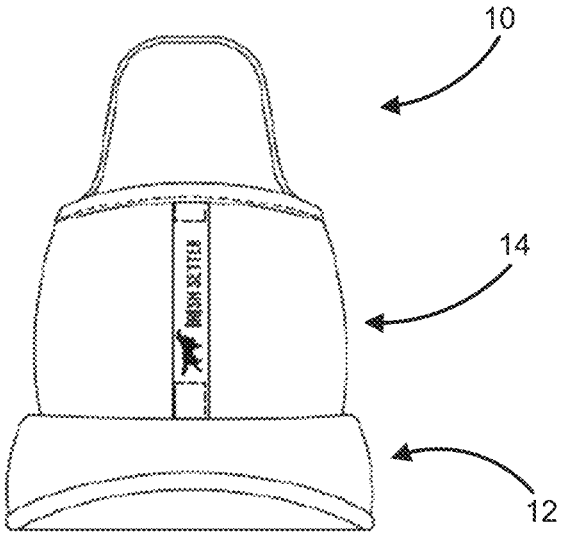
FIG. 2 is a rear view of the footwear of FIG. 1.
Figure 4:
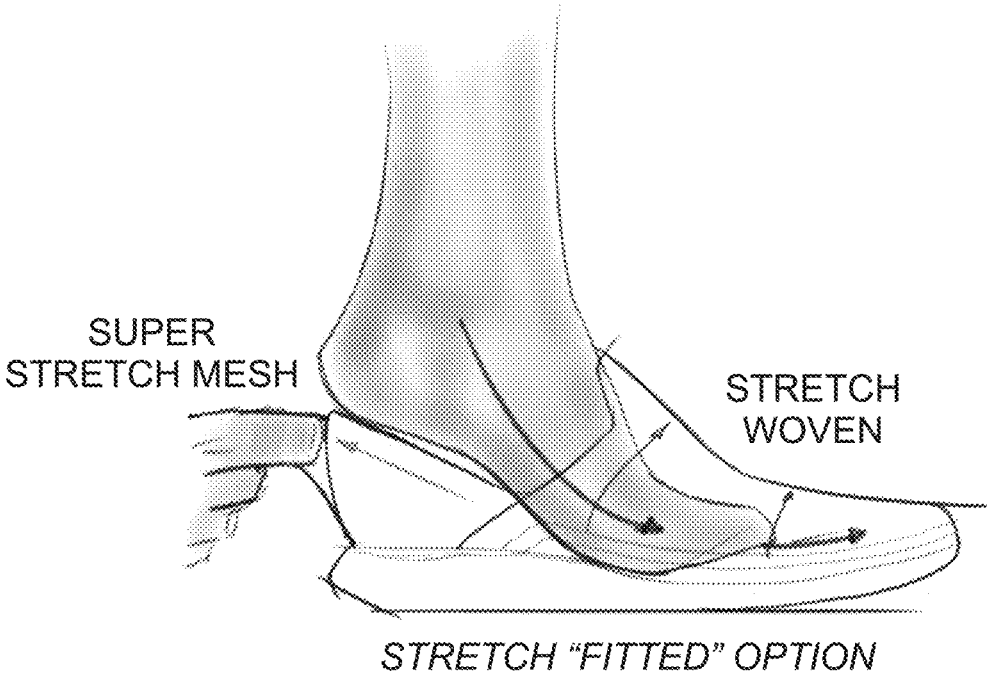
FIG. 4 is a schematic illustration of the footwear of FIG. 1 in a first state.

In the depicted embodiment, the footwear 10 has a heel portion that can be worn in a down position or an up position. FIG. 1 and FIG. 4 show the heel portion in the up position. In the up position, the footwear 10 is securely retained on the user's foot. To put the footwear 10 on, the user pulls back a heel tab to stretch the heel portion rearward and allow the user's heel to enter the footwear 10. To take the footwear 10 off, the user can pull the heel tab to release the user's heel from the footwear 10.

Figure 3:
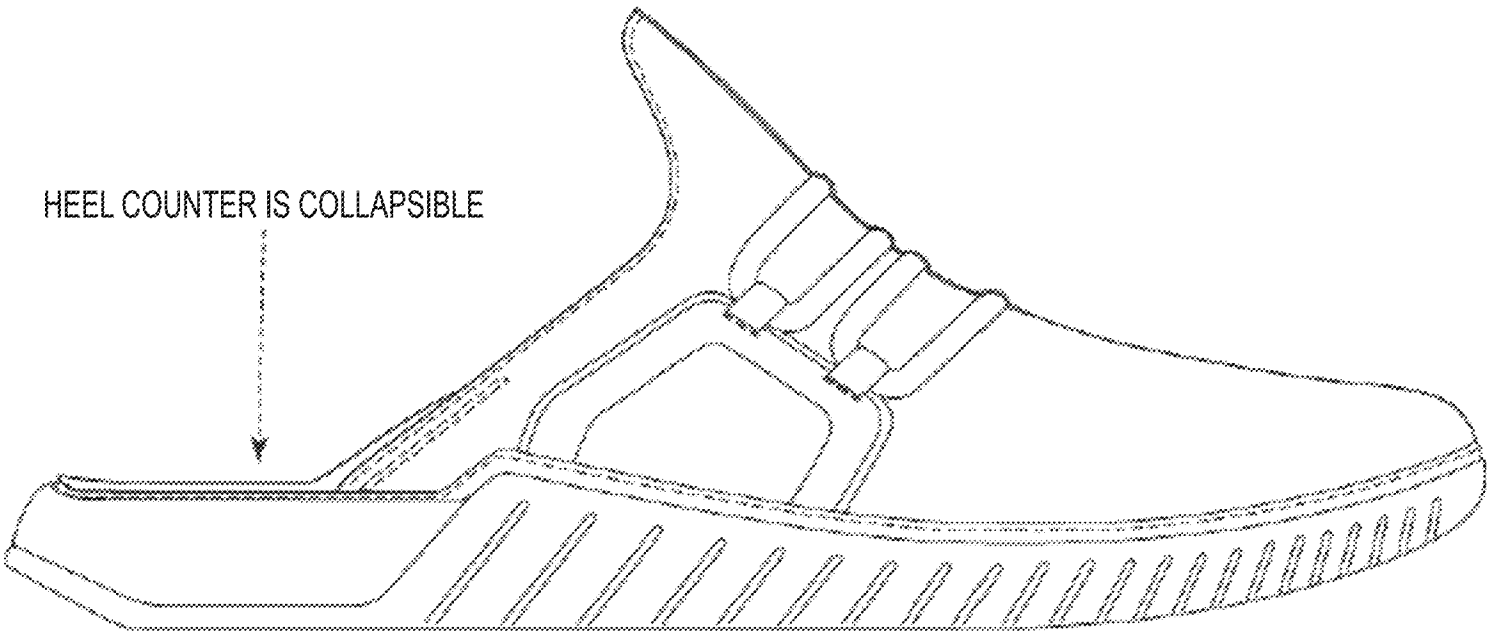
FIG. 3 is a side view of the footwear of FIG. 1 in a second state.
Figure 5:
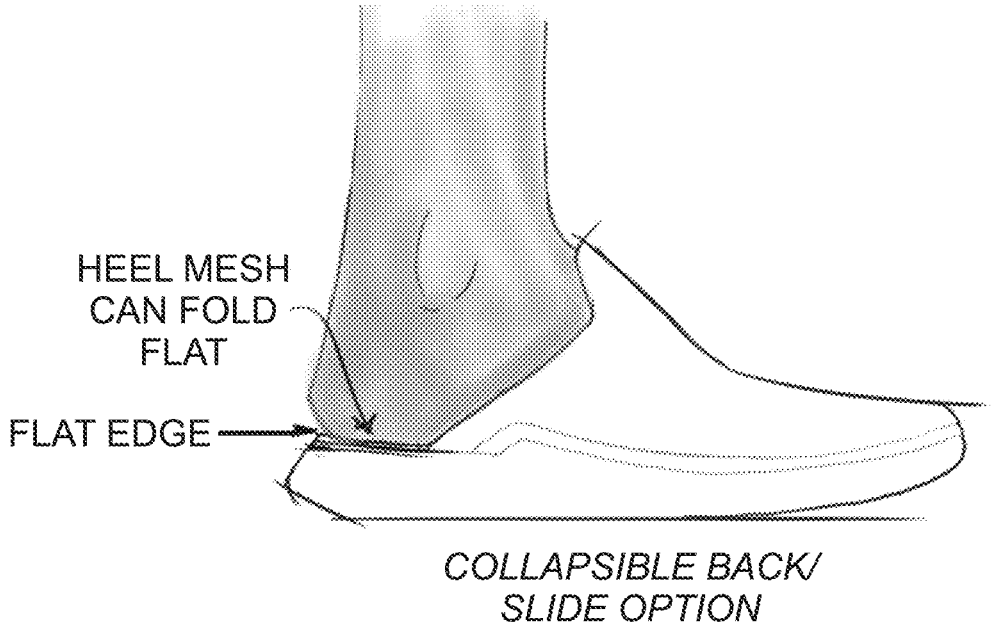
FIG. 5 is a schematic illustration of the footwear of FIG. 1 in a second state.

FIG. 3 and FIG. 5 show the heel portion in the down position. In the down position, the footwear 10 can be worn and very easily put on or taken off. In this state, the user can slide his or her foot into or out of the footwear 10 without touching the footwear 10 with his or her hands.

It should be appreciated in an alternative embodiment the heel portion of the footwear 10 may be constructed differently. The heel portion might not configure to collapse and be worn in a down position. Alternatively, the footwear 10 may have an open back portion.

Figure 6:
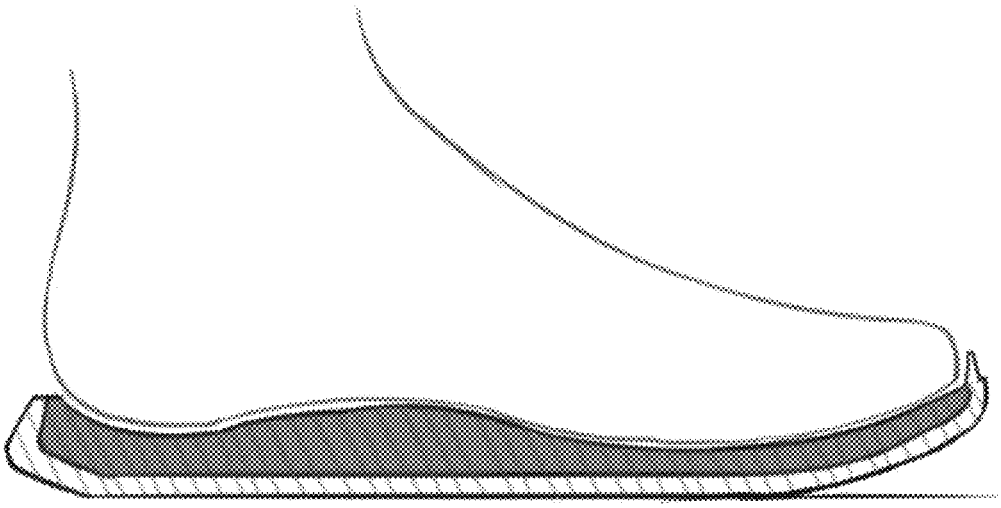
FIG. 6 is a schematic longitudinal cross-sectional view of the sole of the footwear of FIG. 1.
Figure 7:
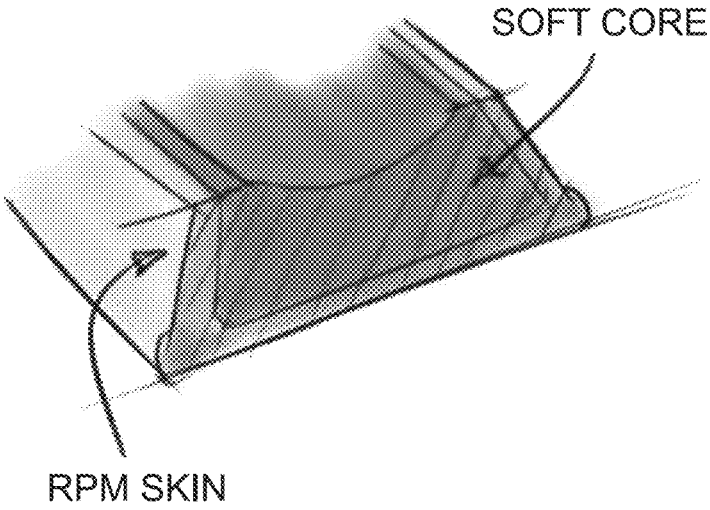
FIG. 7 is a schematic isometric transverse cross-sectional view of the sole of the footwear of FIG. 1.

Referring to FIGS. 6 and 7, the sole 12 includes a main body including a forefoot portion 16, a hindfoot portion 18, and a mid-foot portion 20. The mid-foot portion 20 is located between the forefoot portion 16 and the hindfoot portion 18. The main body includes a ground engaging portion 22, a main body periphery wall portion 24 that extends upwardly from a periphery edge of the ground engaging portion 22, and a foot engaging portion 26 positioned above the ground engaging portion 22. The foot engaging portion 26 includes a forefoot surface 28, a mid-foot surface 30, and a hindfoot surface 32.

In the depicted embodiment, a portion of the ground engaging portion 22 is constructed of a first material. In the depicted embodiment, the portion of the ground engaging portion 22 that is constructed of the first material can be zero to one hundred percent. In the depicted embodiment, a portion of the main body periphery wall portion 24 is also constructed of the first material (see FIG. 7). In the depicted embodiment, the at least a portion of the foot engaging portion 26 is constructed of a second material. In the depicted embodiment, the portion of the foot engaging portion 26 that is constructed of the first material can be zero to one hundred percent. In the depicted embodiment, the first material has a durometer of between 50 to 60. In the depicted embodiment, the second material has a durometer of between 40 to 50. In the depicted embodiment, the first and the second materials are co-molded.

It should be appreciated that many alternative configurations are also possible. For example, the sole 12 could be constructed of a single material or a number of different materials. The materials could be cemented together or another process could be used to form and connect them (e.g., direct injection). In an alternative embodiment, the properties of the materials can also be different than in the depicted embodiment.

Figure 14:
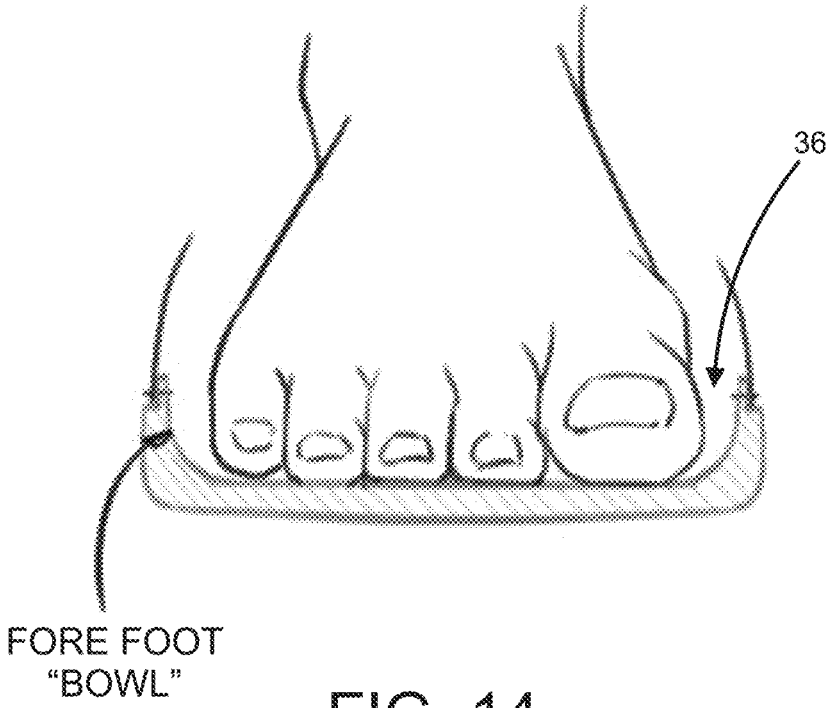
FIG. 14 is a schematic cross-sectional view of the footwear of FIG. 1.

In the depicted embodiment, the main body periphery wall portion 24 extends upwardly to form an upper periphery wall 34 around at least a portion of the forefoot surface 28 in the forefoot portion 16 thereby defining a forefoot bowl 36 (see FIG. 14). In the depicted embodiment, the main body periphery wall portion 24 terminates in a shelf 38 around the hindfoot surface 32 in the hindfoot portion 18. In the depicted embodiment, the upper periphery wall 34 is continuous and extends between 2-9 millimeters above the forefoot surface 28. In the depicted embodiment, the shelf 38 is continuous and is between 3-9 (e.g., at 6-9 mm) millimeters wide. It should be appreciated that many alternative configurations are also possible.

Figure 8:
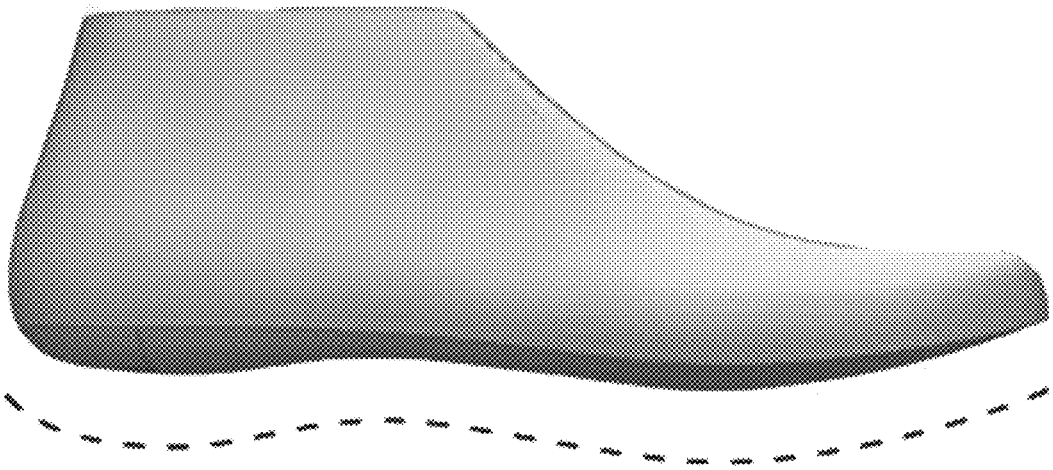
FIG. 8 is a side elevation view of a last used to form the sole of the footwear of FIG. 1.
Figure 9:
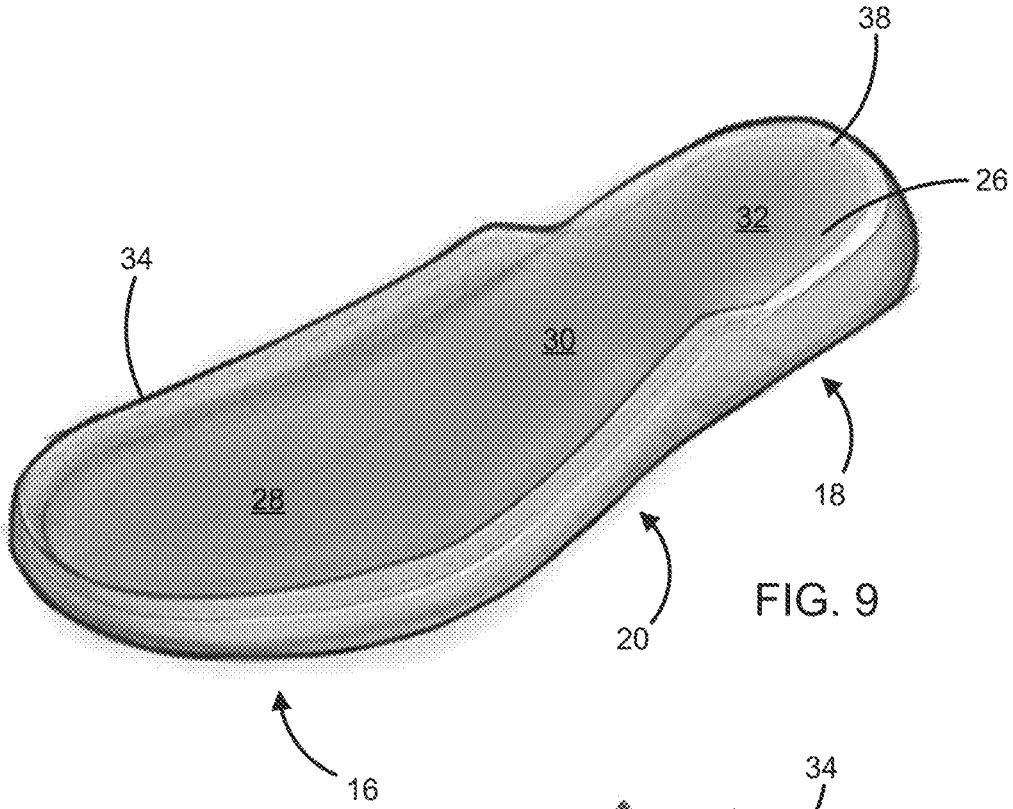
FIG. 9 is a schematic top front isometric view of the sole of the footwear of FIG. 1.
Figure 10:
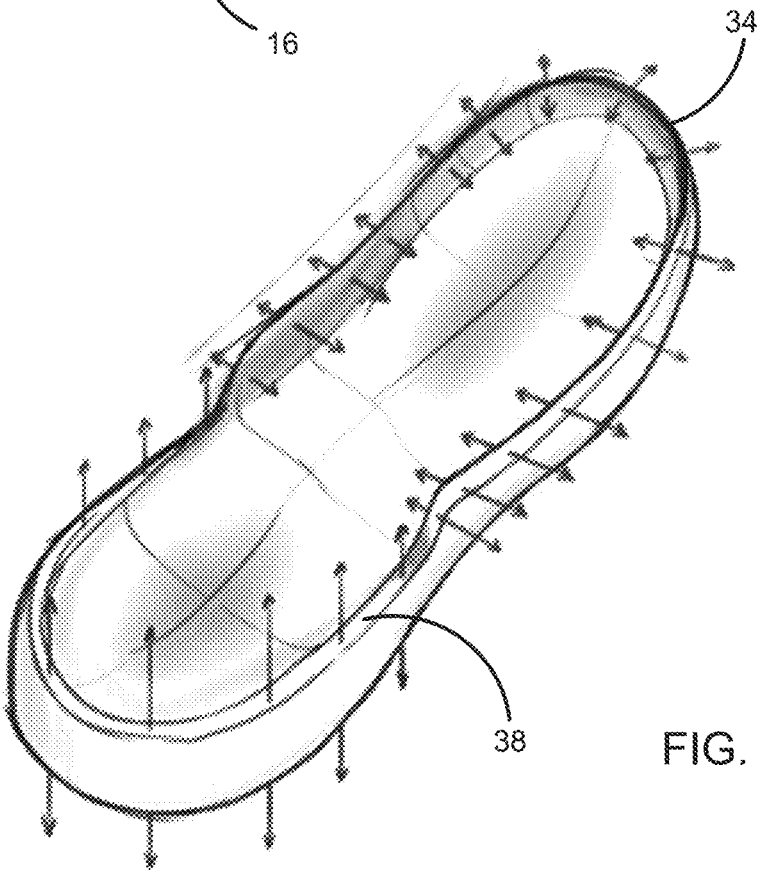
FIG. 10 is a schematic top rear isometric view of the sole of the footwear of FIG. 1.

In the depicted embodiment, the foot engaging portion 26 defines an S-shaped upper longitudinal profile. The upper longitudinal profile includes a first concavity in the forefoot surface 28, a convexity in the mid-foot surface 30, and a second concavity in the hindfoot surface 32. See FIGS. 6 and 8. In the depicted embodiment, the foot engaging portion 26 defines a U-shaped upper transverse profile in the forefoot surface 28 and in the hindfoot surface 32. It should be appreciated that many alternative configurations are also possible. For example, in an alternative embodiment the upper longitudinal profile can be largely flat and the contours that match the profile of the bottom of a user's foot (FIG. 8) can be provided in a removable footbed.

Figure 15:
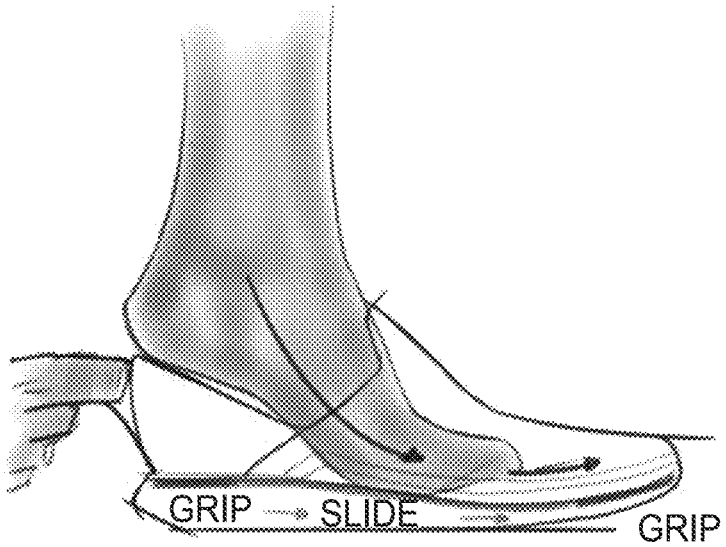
FIG. 15 is a schematic view of the footwear of FIG. 1 in a first state.
Figure 16:
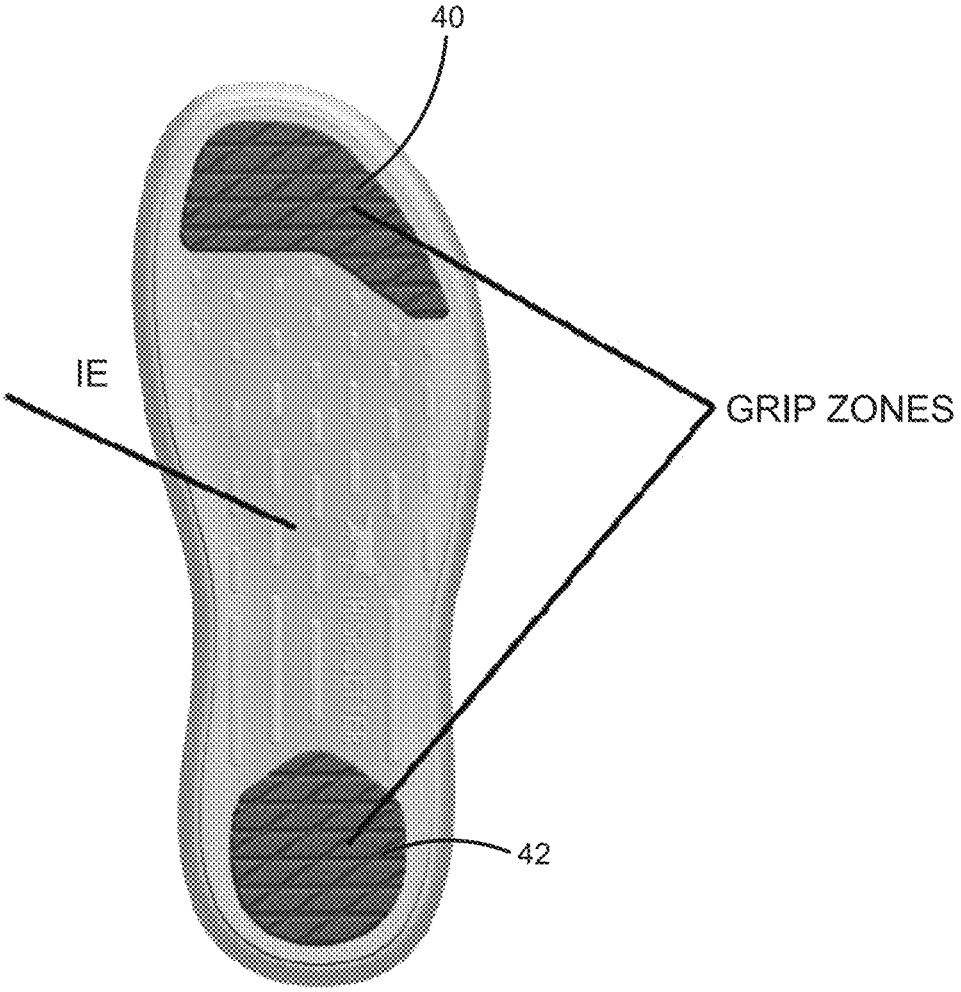
FIG. 16 is a top view of an embodiment of the sole of the footwear of FIG. 1.
Figure 17:
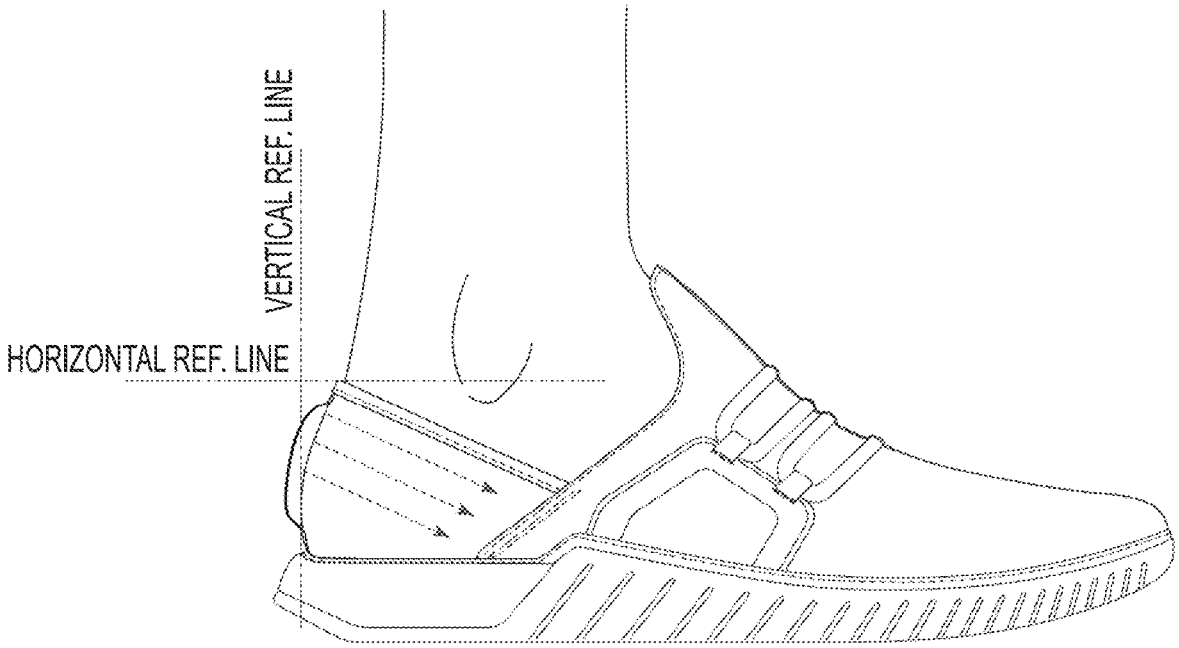
FIG. 17 is a side view of the footwear with a foot in the footwear.
Figure 18:
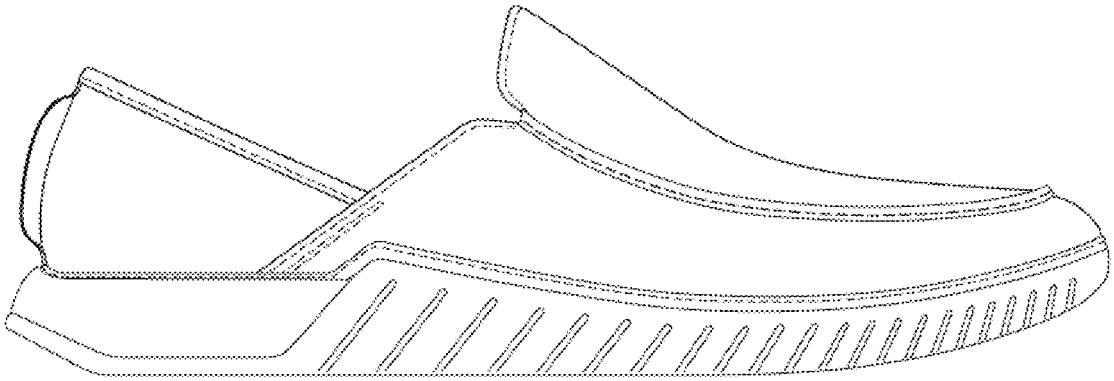
FIG. 18 is a side elevation view of an alternative embodiment of the footwear of FIG. 1.

In the depicted embodiment, the forefoot surface 28, the mid-foot surface 30, and the hindfoot surface 32 are designed to facilitate foot entry and exit, as well as limit foot slide when the user's foot is in the footwear. In the depicted embodiment, the mid-foot surface 30 has a surface construction that provides less friction than at least a portion of the forefoot surface 28 and the hindfoot surface 32. In one embodiment, the forefoot surface 28 and the hindfoot surface 32 include grip pads 40, 42 (see FIG. 16). FIG. 15 depicts the functionality of the variations in surface friction for foot entry and exit. It allows for easy on and off of the footwear 10 while also providing a secure connection between the footwear 10 and the user's foot when the footwear 10 is worn. It should be appreciated that many alternative configurations are also possible. For example, in an alternative embodiment the surface friction can be the same throughout the upper surface of the sole 12.

In the depicted embodiment, the upper 14 includes a vamp 50 positioned above the forefoot portion 16 and a portion of the mid-foot portion 20 of the sole. In the depicted embodiment, the vamp 50 is stitched to the upper periphery wall 34. In the depicted embodiment, the stitches that connect the vamp 50 to the upper periphery wall 34 are a side stitch that extend through the upper periphery wall 34 (see FIGS. 11 and 13). It should be appreciated that many alternative configurations are possible. For example, in an alternative embodiment the upper 14 could be cemented to the lower.

In the depicted embodiment, the upper 14 includes a heel counter 52 positioned above the hindfoot portion 18 of the sole. In the depicted embodiment, the heel counter 52 is stitched to the shelf 38 (see FIGS. 11 and 12). In the depicted embodiment, the stitches that hold the heel counter 52 against the shelf 38 extend downwardly and extend through the thickness of the sole. It should be appreciated that many alternative configurations are possible.

In the depicted embodiment, the upper 14 has no tongue. In the depicted embodiment, the upper 14 also has no operable laces that can be used to adjust the foot volume. In the depicted embodiment, the forefoot volume defined by the vamp 50 is not adjustable by the user. In the depicted embodiment, the upper 14 is constructed such that it can expand to receive a user's foot and contract to provide a snug fit. In the depicted embodiment, the vamp 50 has a single piece construction and is constructed of a high stretch material. It should be appreciated that many alternative configurations are possible.

In the depicted embodiment, the heel counter 52 is constructed of a four-way stretch material. In the depicted embodiment, the heel counter 52 in an unstretched state includes a back edge portion that defines an acute angle relative to the ground engaging portion 22 in the hindfoot portion 18 of the sole 12. In the depicted embodiment, the angle 54 is between 65-86 (e.g., 72-80, or 65-75) degrees relative to the ground engaging portion 22 in the hindfoot portion 18 of the sole 12. In the depicted embodiment, the intersection of a vertical line with the rearmost portion of the heel counter 52 defines a first point and the intersection of a vertical line with the uppermost portion of the heel counter 52 defines a second point. A line that connects the first and second point with reference to a horizontal line defines the angle of the back edge portion. In the depicted embodiment, the orientation of the back edge portion enables the heel counter 52 to impart a partially downward and partially forward force on the user's foot which provides enhanced heel and foot retention. It should be appreciated that many alternative configurations are possible.

In the depicted embodiment, the heel counter 52 and the vamp 50 intersect in a V-shaped notch 54. In the depicted embodiment, the heel counter 52 and the vamp 50 intersect at a location that is within 1-2.5 centimeters from the upper periphery wall 34. It should be appreciated that many alternative configurations are possible.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A footwear comprising:

a sole comprising:

a main body including a forefoot portion, a hindfoot portion, and a mid-foot portion, the mid-foot portion being located between the forefoot portion and the hindfoot portion;

wherein the main body includes a ground engaging portion, a main body periphery wall portion that extends upwardly from a periphery edge of the ground engaging portion, and a foot engaging portion positioned above the ground engaging portion;

wherein the foot engaging portion includes a forefoot surface, a mid-foot surface, and a hindfoot surface;

wherein at least a portion of the ground engaging portion is constructed of a first material;

wherein at least a portion of the foot engaging portion is constructed of a second material;

wherein the main body periphery wall portion extends upwardly to form an upper periphery wall around at least a portion of the forefoot surface in the forefoot portion thereby defining a forefoot bowl; and wherein the main body periphery wall portion terminates in a shelf around the hindfoot surface in the hindfoot portion; and an upper comprising:

a vamp positioned above the forefoot portion and a portion of the mid-foot portion of the sole, the vamp being stitched to the upper periphery wall; and a heel counter positioned above the hindfoot portion of the sole, the heel counter being stitched to the shelf.

2. The footwear of claim 1, wherein the heel counter is stitched to the shelf such that the stitches extend from the shelf downwardly into the sole.

3. The footwear of claim 1, wherein the vamp is stitched to the upper periphery wall such that the stitches extend through the upper periphery wall.

4. The footwear of claim 1, wherein the heel counter includes a back edge that defines an acute angle relative to the ground engaging portion in the hindfoot portion of the sole.

5. The footwear of claim 1, wherein the heel counter includes a back edge that defines an angle between 65-75 degrees relative to the ground engaging portion in the hindfoot portion of the sole.

6. The footwear of claim 1, wherein the heel counter is constructed of a four-way stretch material.

7. The footwear of claim 1, wherein the vamp has a single piece construction.

8. The footwear of claim 1, wherein the vamp is gusset less and has no tongue.

9. The footwear of claim 1, wherein the forefoot surface and the hindfoot surface include grip pads.

10. The footwear of claim 1, wherein the vamp is constructed of a high stretch material.

11. The footwear of claim 1, wherein the heel counter and the vamp intersect at a V-shaped notch.

12. The footwear of claim 1, wherein the heel counter and the vamp intersect at a location that is within 1-2.5 centimeters from the upper periphery wall.

13. The footwear of claim 10, wherein the volume of the stretched vamp is not adjustable by the user.

14. A footwear comprising:

a sole comprising:

a main body including a forefoot portion, a hindfoot portion, and a mid-foot portion, the mid-foot portion being located between the forefoot portion and the hindfoot portion;

wherein the main body includes a ground engaging portion, a main body periphery wall portion that extends upwardly from a periphery edge of the ground engaging portion, and a foot engaging portion positioned above the ground engaging portion;

wherein the foot engaging portion includes a forefoot surface, a mid-foot surface, and a hindfoot surface;

wherein the foot engaging portion defines an S-shaped upper longitudinal profile, including a first concavity in the forefoot surface, a convexity in the mid-foot surface, and a second concavity in the hindfoot surface;

wherein the foot engaging portion defines a U-shaped upper transverse profile in the forefoot surface and in the hindfoot surface;

wherein the forefoot surface and the hindfoot surface include grip pads;

wherein at least a portion of the ground engaging portion is constructed of a first material, the first material having a durometer of between 50 to 60;

wherein at least a portion of the foot engaging portion is constructed of a second material, the second material having a durometer of between 40 to 50;

wherein the first and the second materials are co-molded;

wherein the main body periphery wall portion extends upwardly to form an upper periphery wall around at least a portion of the forefoot surface in the forefoot portion thereby defining a forefoot bowl; and wherein the main body periphery wall portion terminates in a shelf around the hindfoot surface in the hindfoot portion; and an upper comprising:

a vamp positioned above the forefoot portion and a portion of the mid-foot portion of the sole, the vamp being stitched to the upper periphery wall, the vamp being gusset less and having no tongue; and a heel counter positioned above the hindfoot portion of the sole, the heel counter being stitched downwardly to the shelf, the heel counter including a back edge that defines an acute angle relative to the ground engaging portion in the hindfoot portion of the sole.

* * * * *